United States Patent [19]

Vives

[11] Patent Number: 4,523,628

[45] Date of Patent: Jun. 18, 1985

[54] PROCESS FOR CASTING METALS IN WHICH MAGNETIC FIELDS ARE EMPLOYED

[75] Inventor: Charles Vives, Chateaurenard, France

[73] Assignee: Aluminium Pechiney, Paris, France

[21] Appl. No.: 511,398

[22] Filed: Jul. 7, 1983

[30] Foreign Application Priority Data

Jul. 23, 1982 [FR] France ..... 82 1319

[51] Int. Cl.[3] ..... B22D 11/10; B22D 27/02

[52] U.S. Cl. ..... 164/468; 164/504

[58] Field of Search ..... 164/467, 468, 503, 504, 164/147.1, 498, 499

[56] References Cited

U.S. PATENT DOCUMENTS 2,861,302 11/1958 Mann et al. ..... 164/504

2,944,309 7/1960 Schaaber ..... 164/504

*Primary Examiner*—Nicholas P. Godici

*Assistant Examiner*—Kenneth F. Berg

*Attorney, Agent, or Firm*—McDougall, Hersh & Scott

[57] ABSTRACT

A process for casting metals comprising simultaneously applying a stationary magnetic field and a variable magnetic field to the molten metal in the course of solidification. The magnetic fields act in the same direction and generate radial vibrations in the metal, causing the cast metal to have an improved homogeneous structure and surface condition.

9 Claims, 2 Drawing Figures

PROCESS FOR CASTING METALS IN WHICH MAGNETIC FIELDS ARE EMPLOYED

The present invention concerns a process for casting metals in which magnetic fields are employed, in order to enhance the structure and the surface condition of the resulting products.

It is known for metals such as steel, aluminium and alloys thereof to be cast, in the form of billets, plates or ingots, either by casting in a mould or by vertical continuous casting.

In the former process, the mould is filled with a known amount of liquid metal, and the liquid metal is solidified within the mould, by heat exchange with the wall of the mould.

In the second process, the metal, in a molten condition, is poured into a mould which generally has a vertical axis of symmetry and which is open at its two ends and the side walls of which are cooled by a fluid. On coming into contact with the mould, the metal sets to form a crust which gradually increases in thickness as the ingot advances through the mould, whereby, at the lower end of the mould, the thickness of the crust is sufficient to retain the central part which is still in a liquid state. After it has left the mould, the wall of the ingot is cooled directly by spraying water thereonto, thereby fairly quickly causing complete solidification of the metal mass.

In both those processes, the ingot produced is in a highly heterogeneous condition, as it has both a cortical region which is formed by rapid solidification, in contact with the mould, and a central region which results from a slower rate of cooling by heat exchange with the wall of the mould or with the water, through the cortical region. As those regions crystallised at different rates, they are far from having the same structure or the same composition. In addition, the skin or surface layer which is formed on the ingot in contact with the mould is generally irregular. Therefore, in most cases the ingots have to be subjected to supplementary scalping or decrusting operations in order to remove the faulty regions, thereby to prevent the occurrence of defects which would result therefrom, in the course of the subsequent stages of transforming the ingot.

It is for that reason that, in order in particular to enhance the quality of products produced by a casting process, the man skilled in the art has sought solutions to such problems of heterogeneity of surface and structure. In most cases, he has turned to using magnetic fields which are intended to agitate the liquid part of the ingot as it is formed and in particular, rotary fields.

Thus, U.S. Pat. No. 2,963,758 claims a process for reducing the development of basaltic grains, which comprises subjecting the metal, in a molten condition, to a magnetic field, in the direction of the thermal gradient of cooling of the ingot, and continuously displacing said field in a direction substantially perpendicular to the direction of said gradient. The generation of the magnetic field requires the use of a six-pole stator connected to a source of polyphase electrical current. That means that the installation is fairly complicated and the efficiency thereof is subjected to limits imposed by the size of the grains.

In U.S. Pat. No. 3,153,820, the invention concerns an apparatus for improving the physical and chemical homogeneity and structure of the cast metal, by controlling the solidification process. That apparatus comprises, in combination, a plurality of independently operating, external agitators, including electromagnets and electromechanical vibration transducers disposed outside the mass of metal, being regularly spaced and disposed close to the region of cooling of the metal, said agitators producing a plurality of agitation force fields which are concentrated within the metal. Although such an apparatus, which includes several types of devices of fairly complicated design, reduces the phenomena of segregation within the metal, it does not solve the problems concerning the surface condition.

It is for that reason that the present applicants, desiring to improve the casting method in order to produce both more homogenous structures and surface conditions which are directly suitable for the subsequent operations of dimensional transformation, without the necessity to perform a crust removal phase, sought and developed a process using simple equipment which however is used under conditions such that the efficiency thereof is enhanced.

The process according to the invention comprises simultaneously applying a stationary magnetic field and a variable magnetic field, which act in the same direction, in the vicinity of the metal in the course of solidification, in order to generate radial vibrations in said metal.

The uniform magnetic fields is generated by at least one coil which is supplied with direct current. The coil comprises an electrical wire which is wound around a frame, the section of which, in a horizontal plane, is similar in contour to that of the upper section of the mould, and it is positioned above the mould.

Under the effect of the direct current, the coil generates a uniform field which is in a general direction parallel to the axis of symmetry of the mould, that is to say, which is substantially vertical and oriented either upwardly or downwardly. The lines of that field may be modified by incorporating within the coil, an iron core which matches the contour thereof, while leaving at its centre a sufficient amount of space for the feed of liquid metal to the mould.

The variable magnetic field is generated by an annular inductor which is of similar geometry but which is supplied with a periodic current of a frequency N. The inductor is disposed above the mould, either above the coil which is supplied with direct current, or between the coil and the mould. It may also be disposed at the level of the mould. In the latter case, when there are two coils which are supplied with direct current, it is disposed therebetween. Under the effect of the periodic current, the inductor generates a variable field which acts in the same direction as the stationary field, which produces an induced current in the mould. The density vector is disposed in a plane which is generally horizontal and directed perpendicularly to a straight line of said plane, which passes through the axis of the mould. The assembly of such vectors therefore forms concentric circles.

The combined action of the magnetic fields generates in the metal vibrations which are of a double origin. On the one hand, the stationary field and the induced current develop a force perpendicular to the plane formed by the current density vector and the stationary field direction vector. That force is therefore contained in a horizontal plane and directed towards the axis of the mould. That force is of a strength which varies periodically at the same frequency N as the variable field, and therefore produces vibrations in the metal.

On the other hand, by virtue of the interaction between the variable field and the induced current, both at a frequency N, another radial force is developed, which is also variable, but which is at a frequency of 2 N. Thus, the metal is subjected to those two radial forces, at frequencies N and 2 N, hence resulting in the mass of liquid metal being generally set vibrating.

As a result of certain defects in regard to the geometry of the system, more or less substantial "fringe" effects may occur, resulting in vertical vibration, but such vibration is relatively insignificant in comparison with the radial vibration.

The periodic current which is used to feed the variable field inductor may be of purely sinusodial shape, but any other shape is also suitable for carrying the invention into effect.

As regards the frequency involved, it may cover a whole range of values from 5 to 100,000 Hertz. However, a distinction should be made between the frequencies which are referred to as low frequencies, at from 5 to 100 Hertz, and higher frequencies, referred to as medium frequencies.

In the first case, the so-called "skin" effect of the variable field is reduced, that is to say, the induced current applies the action thereof to a thickness of metal such that there is sufficient interaction of that current with the stationary field to produce vibrations throughout the mass of metal. That mode of operation is referred to as the force vibration mode. On the other hand, as the frequency of the variable field rises, the skin effect becomes substantial and the interaction of the induced current with the stationary field becomes increasingly weaker. In that case, the vibrations produced, in order to be of suitable efficiency, must be capable of going into resonance with the natural vibrations of the liquid metal, the dendrites which are being formed, or the solid mass. Now, such natural vibrations depend on the format of the cast product, the speed of casting, the nature of the metal and the cooling conditions. The proper frequency for obtaining resonance of the mass of metal is easily found by methods known to those skilled in the art. The current is then adjusted to this frequency to obtain the resonance condition.

It is certain that, when using low frequencies, the technology and the mode of operation involved are simpler and the harmful effects resulting from noise due to vibration are relatively minor.

In an alternative form of the process, which is applied in particular to the continuous casting of steel, it is an attractive proposition to generate stationary and variable magnetic fields by means of a series of coils and inductors which are disposed in alternate succession all along the part of the metal which is in the course of soldification. In fact, in that case, that part of the ingot may be relatively long and efficiency of the fields is then achieved by multiplying the number of coils and inductors.

As continuously cast metal solidifies, the mass of liquid decreases from top to bottom and its proper vibration frequency varies. The frequency of the inductors must also be changed to follow these changes in the vibration frequency of the metal. Therefore, in order further to increase the level of efficiency, it is preferable, when the variable field is of a frequency of less than 100 Hertz, for each successive inductor from top to bottom along the length of the solidifying metal to be supplied with a frequency which is lower than that of the previous inductor. That mode of operation accordingly attenuates the skin effect and makes it possible to develop vibrations in the heart of the ingot. For example, the arrangement may comprise, at the level of the mould, an inductor which is supplied at a frequency of 50 Hertz and then, below that, and separated in each case by a direct current coil, a series of inductors which are successively supplied at 20, 10 and 5 Hertz.

BRIEF DESCRIPTION OF DRAWINGS

The present invention will be better appreciated by referring to the accompanying drawings, in which:

Referring to FIG. 1, shown therein is a mould 1 which is cooled by circulation of water as indicated at 2, for forming an ingot 4 from a liquid metal 3. In accordance with the invention, on the top, the mould has been provided with a coil 5 which generates a stationary or steady field, the force lines of which may be modified by the core 6. Disposed at the level of the mould is an inductor 7 which generates a variable field. Under the combined action of the fields, vibrations are developed in the liquid, the direction of propagation of the vibrations being represented by arrows 8.

FIG. 2 shows a view of the liquid metal vibrating in the directions indicated at 8.

Figure 1:
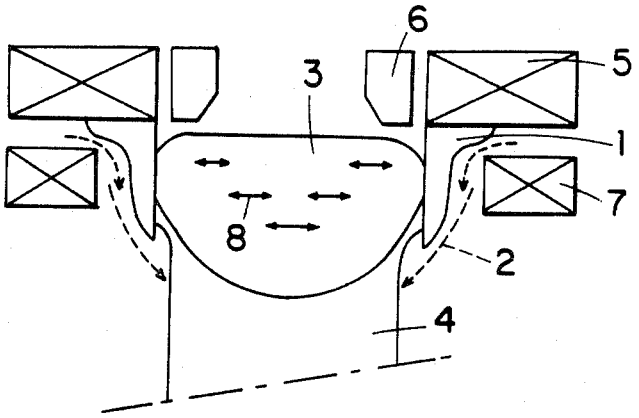
FIG. 1 is a longitudinal cross-sectional view through a vertical plane through the axis of the ingot of the apparatus according to the present invention.
Figure 2:
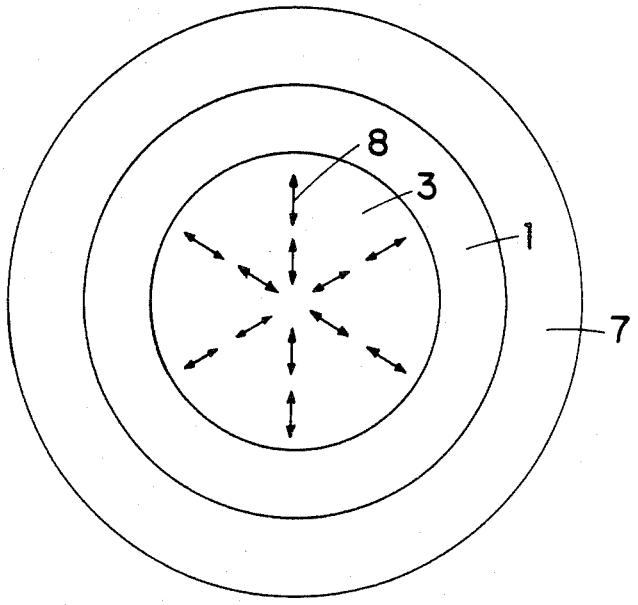
FIG. 2 is a plan view of the metal in the mould.

The invention may be illustrated by reference to the following nonlimiting example.

Continuous casting is effected using an aluminium alloy of type 2024 which has been previously refined by the addition of 0.1% by weight of AT5B, in the form of a plate measuring 300×800 mm.

The first part was produced in a conventional ingot mould and then the casting process was continued under the same conditions in respect of speed and cooling, but while applying, in the vicinity of the free surface of the metal, on the one hand, a stationary magnetic field of 0.04 tesla, generated by means of an annular coil supplied with a direct current of 17500 ampere turns, at a voltage of 24 volts, and, on the other hand, a variable magnetic field, at a frequency of 50 Hertz, which is generated by means of an annular coil disposed below the previous coil, and at the level of the mould, being supplied with an alternating current of 3800 ampere turns, at a voltage of 75 volts.

When the surfaces of samples taken from the two parts of the plate were subjected to micrographic examination, it was found that the number of grains was eight times greater when the process according to the invention was applied.

In addition, surface defects such as tearing or catching, or an oxide skin, which appeared on the first part, had virtually disappeared on the second part.

The invention can be used in any circumstances where the structure and the surface condition of articles produced by casting in a mould or by continuous casting are to be improved, in particular in the aluminium industry.

I claim:

1. In a method for continuously and semi-continuously casting metals where the molten metal to be cast is poured into a mold to be solidified progressively into dendrites and solid mass, the improvement comprising applying a stationary magnetic field to the molten metal in the mold, and simultaneously applying a variable magnetic field to the molten metal in the mold, said fields being applied to act in the same direction on the molten metal in order to generate radial vibrations in the metal in the course of solidification, thereby improving the structure and surface condition of the cast metal.

2. A process according to claim 1 characterised in that the stationary magnetic field is of a value of less than 0.5 tesla.

3. A process according to claim 2 characterised in that the stationary field is modified by the presence of an iron core.

4. A process according to claim 1 characterised in that the frequency of the variable field is from 5 to 100,000 Hertz.

5. A process according to claim 4 characterised in that, when the frequency is higher than 100 Hertz, the frequency values selected are those which go into resonance with the natural frequencies of the molten metal, the dendrites in the course of formation, or the solid mass.

6. A process according to claim 1 characterised in that the stationary field is generated by at least one annular coil.

7. A process according to claim 1 characterised in that the variable field is generated by at least one annular inductor.

8. A process according to claims 6 or 7 characterised in that the coils and the inductors for generating the stationary field and the variable field are disposed in alternate succession along the metal in the course of solidification.

9. A process according to claim 8 characterised in that, when the inductors generate a variable field at a frequency of less than 100 Hertz, each successive inductor from top to bottom along said metal is supplied with a frequency which is lower than that of the previous inductor.

* * * * *

UNITED STATES PATENT AND TRADEMARK OFFICE

CERTIFICATE OF CORRECTION

PATENT NO. : 4,523,628

DATED : June 18, 1985

INVENTOR(S) : Charles Vives

It is certified that error appears in the above-identified patent and that said Letters Patent is hereby corrected as shown below:

Title Page: [30] Foreign Application Priority Data, "82 1319" should be -- 82 13219 --.

Signed and Sealed this

*Twenty-fifth* Day of *March 1986*

[SEAL]

*Attest:*

DONALD J. QUIGG

*Attesting Officer*

*Commissioner of Patents and Trademarks*